US007740504B2

(12) United States Patent
Chikamatsu et al.

(10) Patent No.: US 7,740,504 B2
(45) Date of Patent: Jun. 22, 2010

(54) FUSE AND POWER CIRCUIT BREAKER INCLUDING THE SAME

(75) Inventors: Yasukazu Chikamatsu, Shizuoka (JP); Masahiro Deno, Shizuoka (JP); Shigeyuki Ogasawara, Shizuoka (JP); Yasuyoshi Fukao, Aichi (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 12/153,753

(22) Filed: May 23, 2008

(65) Prior Publication Data

US 2008/0242150 A1 Oct. 2, 2008

(30) Foreign Application Priority Data

Mar. 16, 2006 (JP) ..... 2006-072910

(51) Int. Cl.
*H01R 13/68* (2006.01)

(52) U.S. Cl. ..... 439/620.3; 337/186

(58) Field of Classification Search ..... 439/620.26, 439/907, 490, 620.33, 620.01, 620.3, 160, 439/354; 337/242, 186
See application file for complete search history.

(56) References Cited

U.S. PATENT DOCUMENTS 2,175,987 A * 10/1939 Dodge ..... 337/242
5,739,739 A * 4/1998 Muramatsu et al. ..... 337/234
2006/0035495 A1 * 2/2006 Iwata et al. ..... 439/160

FOREIGN PATENT DOCUMENTS

JP 10-83753 3/1998
JP 2007-250386 9/2007

* cited by examiner

*Primary Examiner*—Edwin A. Leon
(74) *Attorney, Agent, or Firm*—Edwards Angell Palmer & Dodge LLP

(57) ABSTRACT

A power circuit breaker having a simple structure with a small number of components is provided. The power circuit breaker includes: a circuit receiver which receives a pair of circuit terminals connected to an end of an opened power circuit; and a plug body having a fuse to be mounted on the circuit receiver to close the power circuit. In the fuse, a pair of terminals extending from a housing, which receives a fuse element of the fuse, is bent approximately at right angles at the middle of the terminal. A central curving portion of the bent part is provided with a notch. A cross section of the terminal exposed within the notch is pressed by a jig, which fits with the notch, so that the fuse is press-fit into the plug body.

3 Claims, 8 Drawing Sheets

FUSE AND POWER CIRCUIT BREAKER INCLUDING THE SAME

BACKGROUND OF THE INVENTION (1) Field of the Invention

The present invention relates to a fuse, which breaks a power circuit by fusing in response to an overcurrent, and to a power circuit breaker (service plug) including such a fuse.

(2) Description of the Related Art

For example, as for an electric vehicle, because the capacitance of an electric power source, which is a battery, is larger than that of a normal gasoline engine vehicle, a power circuit is opened by a power circuit breaker so as to secure the safety of maintenance work when an electric system of the electric vehicle is being checked and maintained. FIG. 8 shows an example of such a conventional power circuit breaker (for example, see Japanese Patent Application Laid-Open H 10-83753).

A power circuit breaker 101 shown in FIG. 8 includes a circuit receiver 102 having female terminals 120 connected to an end part of an opened power circuit and a plug body 103 which electrically connects the female terminals 120 to each other. The plug body 103 includes a pair of male terminals 130 to be fit to the female terminals 120 and a fuse 140 arranged between the pair of the male terminals 130.

The fuse 140 includes a fuse element received in a housing 141 made of synthetic resin and a pair of tab-shaped terminals 142, one end of which is connected to the fuse element and another end of which projects outside of the housing 141. As shown in FIG. 9, the pair of the male terminals 130 is inserted in through holes formed at the other end of the tab-shaped terminals 142 and nuts 143 are screwed into the respective male terminals 130, so that the fuse 140 is unified with the pair of the male terminals 130.

The plug body 103 and the circuit receiver 102 are fit to each other so that the female terminals 120 are fit to the respective male terminals 130, thereby the power circuit breaker 101 closes the power circuit. The power circuit breaker 101 opens the power circuit by removing these fitting. When an overcurrent flows in the closed power circuit, the power circuit is electrically broken by fusing the fuse element of the fuse 140.

However, the power circuit breaker 101 described above has a problem in that it requires a structure for fixing the pair of the male terminals 130 and the tab-shaped terminals 142 of the fuse 140 as wall as a structure for fixing the pair of the male terminals 130 unified with the fuse 140 to the plug body 103, causing an increase in the number of parts and in the number of man-hours for assembling.

SUMMARY OF THE INVENTION

It is therefore an objective of the present invention to solve the above problem and to provide a fuse which can be easily attached to a connector housing and a power circuit breaker, which includes such a fuse and has a simple structure with a small number of components.

In order to attain the above objective, the present invention is to provide a fuse including:

a tube-shaped housing;

a fuse element received in the housing; and a pair of plate-shaped terminals, one end part of which is received in the housing and connected to the fuse element, while an opposite end part of which is positioned outside the housing, wherein the plate-shaped terminal is provided with a bent part bent in such a manner that a surface on the side of the one end part and a surface on the side of the opposite end part meet each other at right angles, wherein the bent part is provided with a notch in a carrying portion to be pressed by a jig for press-fitting the fuse into a connector housing, into which the fuse is mounted.

With the construction described above, since the bent part has the notch, therefore a cross section on the side of the opposite end part of the terminal can be exposed and can be pressed along a direction of flat surface on the side of the opposite end part of the terminal by the jig, which is inserted in the notch. Thereby, the terminal can be press-fit into the connector housing without being deformed. Further, since the fuse can be mounted into the connector housing by press-fitting, therefore no screwing is required.

In order to attain the above objective, the present invention is also to provide a power circuit breaker including:

a first connector housing into which the fuse described above is press-fit and mounted; and a second connector housing including a pair of circuit terminals, each of which is connected to an electronic instrument and is capable of connecting to the plate-shaped terminal, the second connector housing being capable of fitting to the first connector housing, wherein the pair of the plate-shaped terminals of the fuse is connected to the pair of the circuit terminals when the first and second connector housings are fit to each other.

With the construction described above, since the fuse, which can be mounted into the connector housing by press-fitting, is used, therefore a fixing structure such as a screwing structure is not required, so that a power circuit breaker having a simple structure with a small number of components can be provided. With the fuse described above, the terminal can be press-fit into the first connector housing without being deformed, thereby improving a yield.

The first connector housing has a cover which includes:

a cover body covering a side of the first connector housing on which side the fuse is mounted; and a presser part which rises up from the cover body and fits with the notch so as to prevent the fuse from coming out from the first connector housing.

With the construction described above, since the presser part of the cover presses the fuse toward the first connector housing, therefore the fuse can be securely prevented from coming out from the first connector housing. Further, since the presser part fits with the notch of the bent part so as to press the cross section, which is situated on the side of the opposite end part of the terminal, along the direction of the flat surface, which is situated on the side of the opposite end part of the terminal, therefore the terminal can be held in the first connector housing without being deformed.

DESCRIPTION OF THE PREFERRED EMBODIMENTS

In the following, a preferred embodiment of the present invention will be explained with reference to the attached drawings.

Figure 1:
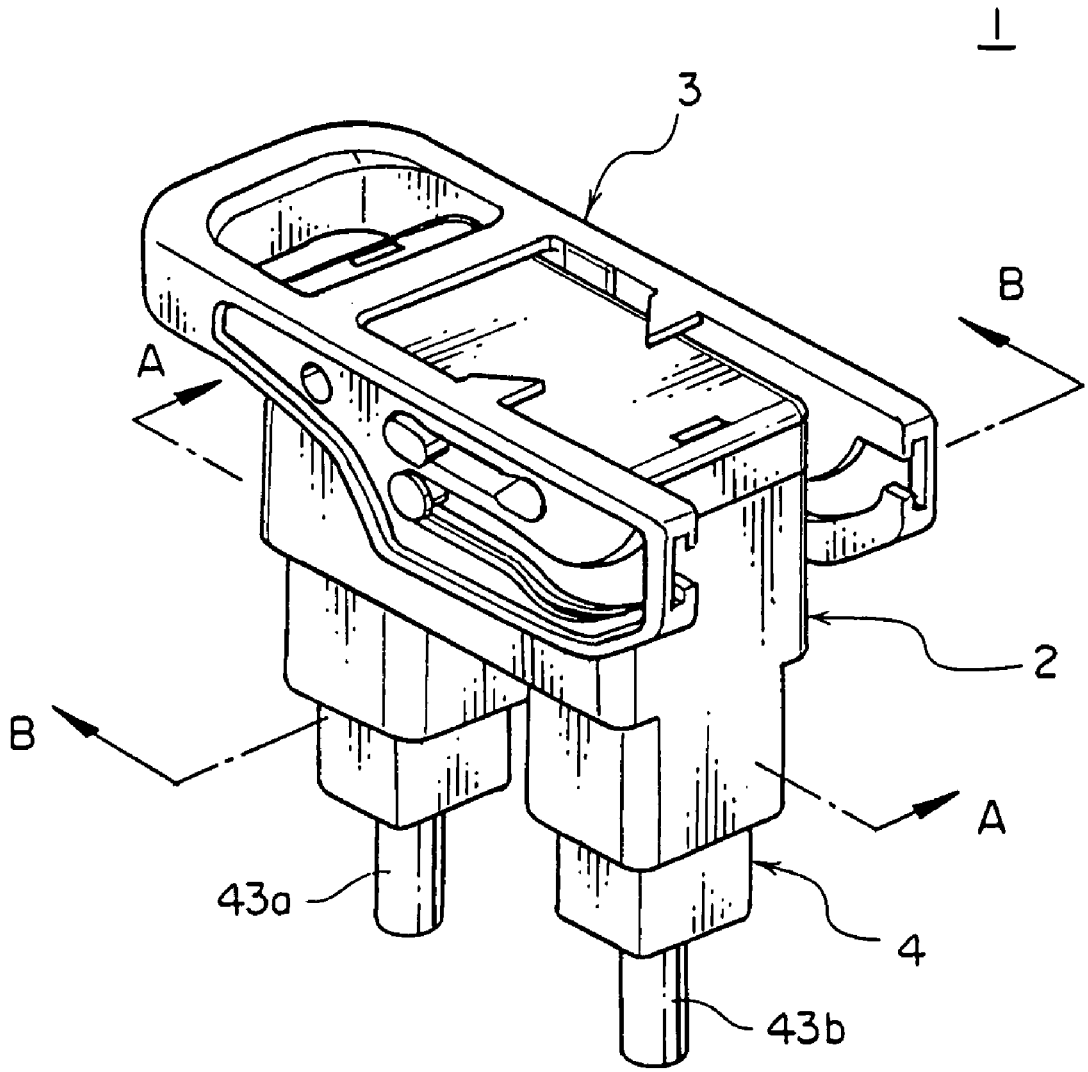
FIG. 1 is a perspective view illustrating a power circuit breaker according to a preferred embodiment of the present invention.
Figure 2:
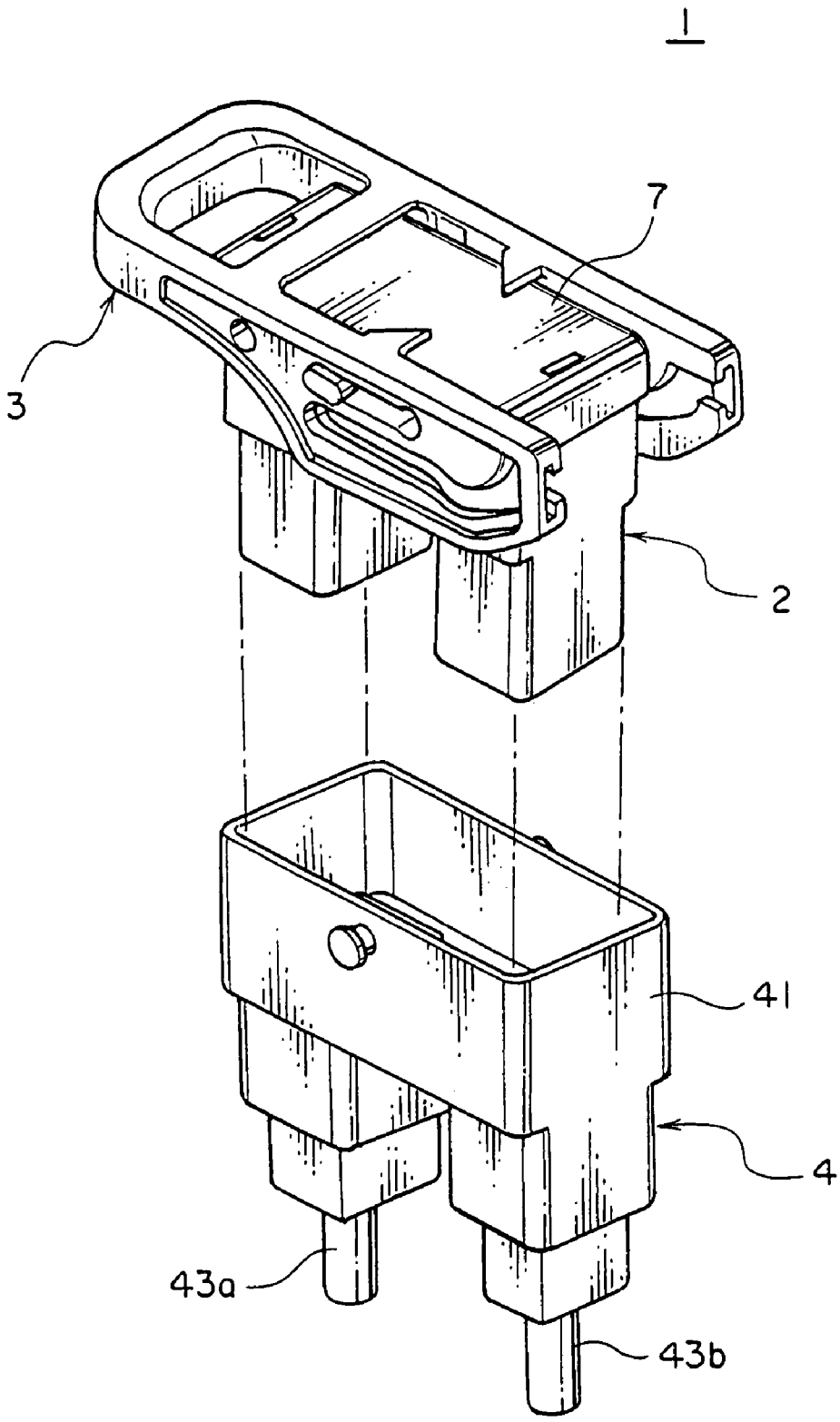
FIG. 2 is an exploded perspective view of the power circuit breaker shown in FIG. 1.

A power circuit breaker 1 according to the preferred embodiment of the present invention is mounted on an electric vehicle and arranged between a battery as an electronic instrument and a load as an electronic instrument. As shown in FIGS. 1 and 2, the power circuit breaker 1 includes a plug body 2 as the first connector housing, a lever 3 made of synthetic resin attached to the plug body 2, and a circuit receiver 4 as the second connector housing to which the plug body 2 is fit by operating the lever 3.

The plug body 2 includes a housing body 5 made of synthetic resin, a fuse 6 to be press-fit and mounted into the housing body 5, and a cover 7 made of synthetic resin.

The housing body 5 is formed in a tube-shape and attaches the rotatable lever 3 on an outer surface of the housing body 5. The housing body 5 is received in a housing body 41 (explained later) of the circuit receiver 4 and approaches or leaves the housing body 41 by rotation operation of the lever 3. Both end parts of the housing body 5, in a direction in which the housing body 5 approaches or leaves the housing body 41, communicate with the outside. The fuse 6 is inserted into the housing body 5 from an opening 51 formed at the end part of the housing body 5 located on the upper side in FIG. 3, while a circuit terminal 42 (explained later) is inserted into the housing body 5 from an opening 52 formed at the end part of the housing body 5 located on the lower side in FIG. 3.

The fuse 6 includes a tube-shaped housing 61 made of synthetic resin, a fuse element (not shown in the figure) received in the housing 61, and a pair of terminals 62. The terminal 62 is made of electrically conductive metal. One end part of the terminal 62 is received in the housing 61 and connected to the fuse element, while an opposite end part of the terminal 62 is positioned outside the housing 61.

Figure 3:
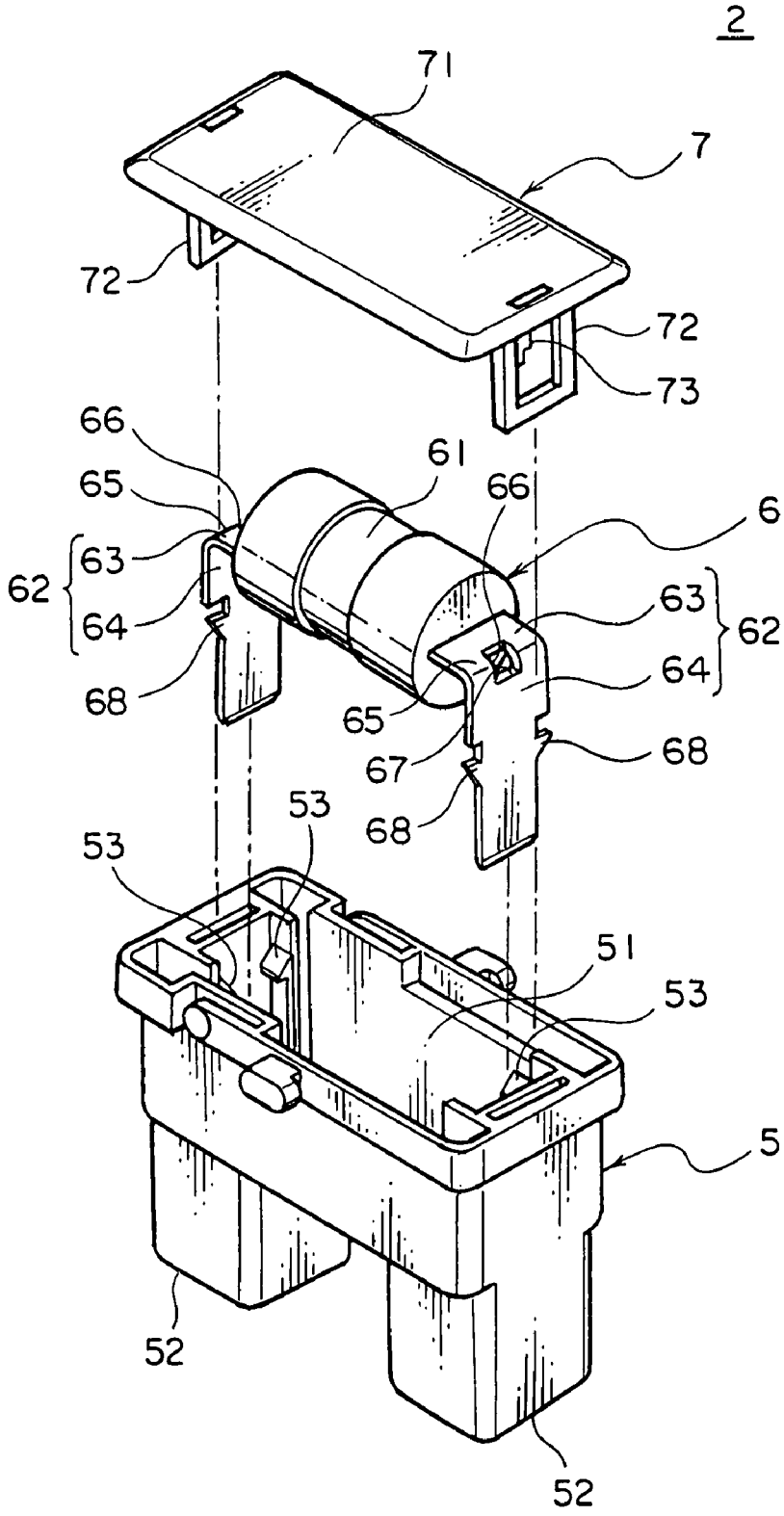
FIG. 3 is an exploded perspective view of a plug body constructing the power circuit breaker shown in FIG. 2.

As shown in FIG. 3, the terminal 62 is bent at a middle part thereof in such a manner that a surface on the side of the one end part and a surface on the side of the opposite end part meet each other at right angles. Hereinafter, the part of the terminal 62 bent in the above manner is called a bent part 65. A part of the terminal 62 situated nearer to the housing 61 than the bent part 65 situated is called a first surface 63, while a part of the terminal 62 situated farther from the housing 61 than the bent part 65 situated is called a second surface 64.

The first surface 63 of one terminal 62 is connected to the other surface 63 of another terminal 62 through the fuse element within the housing 61. When an overcurrent flows in the fuse 6, the fuse element melts so that the connection between the pair of the terminals 62 is electrically broken. When the fuse 6 is inserted into the housing body 5, the first surface 63 climbs over a locking lance 53 (shown in FIGS. 3 and 5) formed in the housing body 5. When the locking lance 53 fits with an upper face of the first surface 63 on a condition that the fuse 6 is mounted in the housing body 5, the fuse 6 is prevented from coming out from the housing body 5.

The second surface 64 extends along an inner surface of the housing body 5 and is connected to a circuit terminal 42 (explained later) when the plug body 2 fits to the circuit receiver 4. The second surface 64 includes a pair of locking parts 68, which projects from respective edges in the width direction of the second surface 64 crossing at right angles an insertion direction, in which the second surface 64 is inserted toward the housing body 5, toward the outside of the width direction. The locking part 68 engages with a mating locking part 54 (see FIG. 5) formed in the housing body 5, so that the fuse 6 is prevented from coming out from the housing body 5.

When the locking part 68 engages with the mating locking part 54, the mating locking part 54 is elastoplastically deformed. Similarly, when the first surface 63 climbs over the locking lance 53, the locking lance 53 is elastoplastically deformed. That is, when the fuse 6 is mounted into the housing body 5, the fuse 6 is press-fit into the housing body 5 with making the mating locking part 54 and the locking lance 53 be subjected to the elastoplastic deformation.

As shown in FIG. 3, the central curving part of the bent part 65 is provided with a notch 66 formed ranging to both of the first surface 63 and the second surface 64. The notch 66 is formed in a rectangular shape and penetrates through the terminal 62. A cross section 67 of the second surface 64, exposed by providing the notch 66, is formed extending in a direction crossing at right angles a direction of a flat surface of the second surface 64. When the fuse 6 is press-fit into the housing body 5, a jig 10 (shown in FIG. 6) abuts against the notch 66 so as to press the fuse 6.

Figure 6:
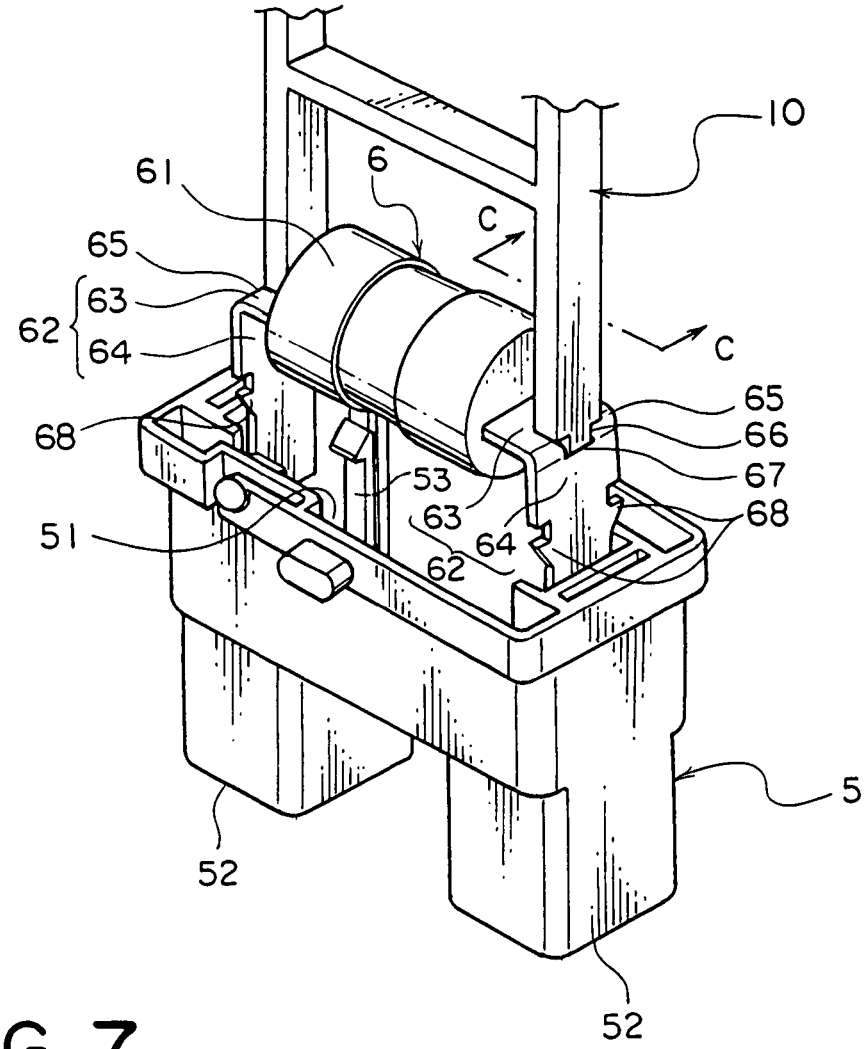
FIG. 6 is a perspective view illustrating a state when a fuse shown in FIG. 5 is being press-fit into a housing.

As shown in FIG. 6, when the fuse 6 is being mounted into the housing body 5, the second surface 64 of the fuse 6 is inserted into the housing body 5 so as to position the fuse 6, and the bar-shaped jig 10, an end of which is formed so as to fit with the notch 66, is allowed to abut against the notch 66 and press the fuse 6 toward the housing body 5.

Figure 7:
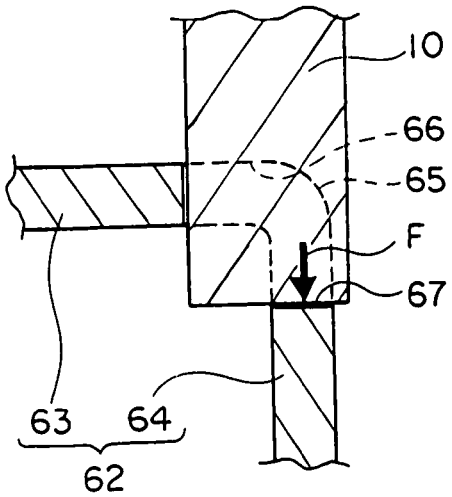
FIG. 7 is a cross sectional view taken along C-C line in FIG. 6.
Figure 8:
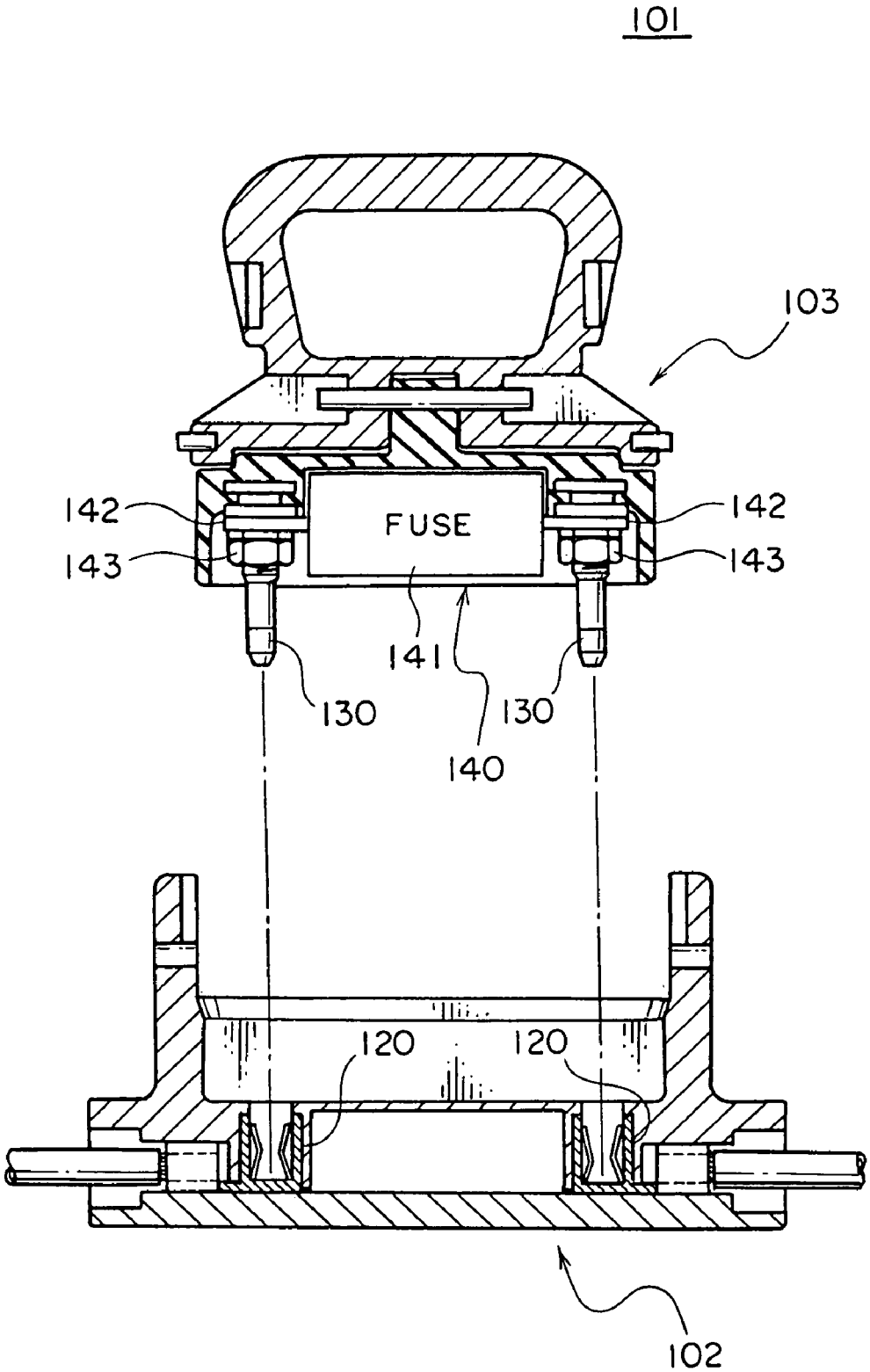
FIG. 8 PRIOR ART
FIG. 8 is an exploded cross sectional view illustrating a conventional power circuit breaker.
Figure 9:
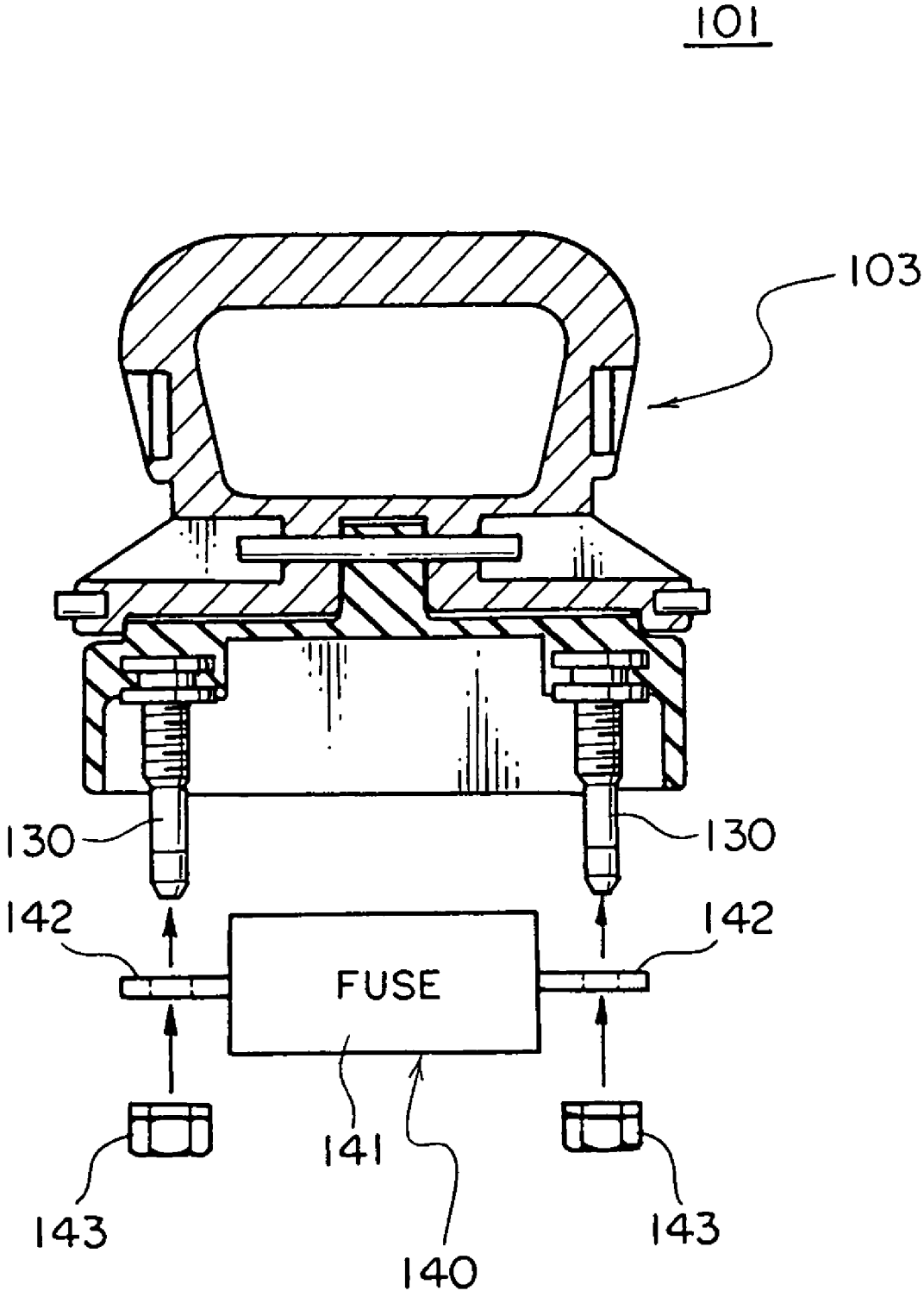
FIG. 9 PRIOR ART
FIG. 9 is a cross sectional view illustrating a state when the conventional power circuit breaker shown in FIG. 8 is being assembled.

At that time, as shown in FIG. 7, the cross section 67 of the second surface 64, which abuts against the jig 10, receives pressing force F (shown in FIG. 7) having a direction facing the housing body 5 along the direction of the flat surface of the second surface 64. Thereby, the fuse 6 is press-fit into the housing body 5 without deformation of the terminal 62. Then, as described above, the locking part 68 engages with the mating locking part 54 and the first surface 63 climbs over the locking lance 53, so that the fuse 6 is fastened in the housing body 5.

When the fuse 6 is mounted in the housing body 5, the cover 7 is attached to the housing body 5 with covering the opening 51 of the housing body 5. The cover 7 includes a cover body 71 formed in a rectangular plate-shape so as to cover the opening 51, a pair of locking parts 72 rising up from the cover body 71 toward the housing body 5, and a pair of presser parts 73 rising up from the cover body 71 toward the housing body 5.

Figure 4:
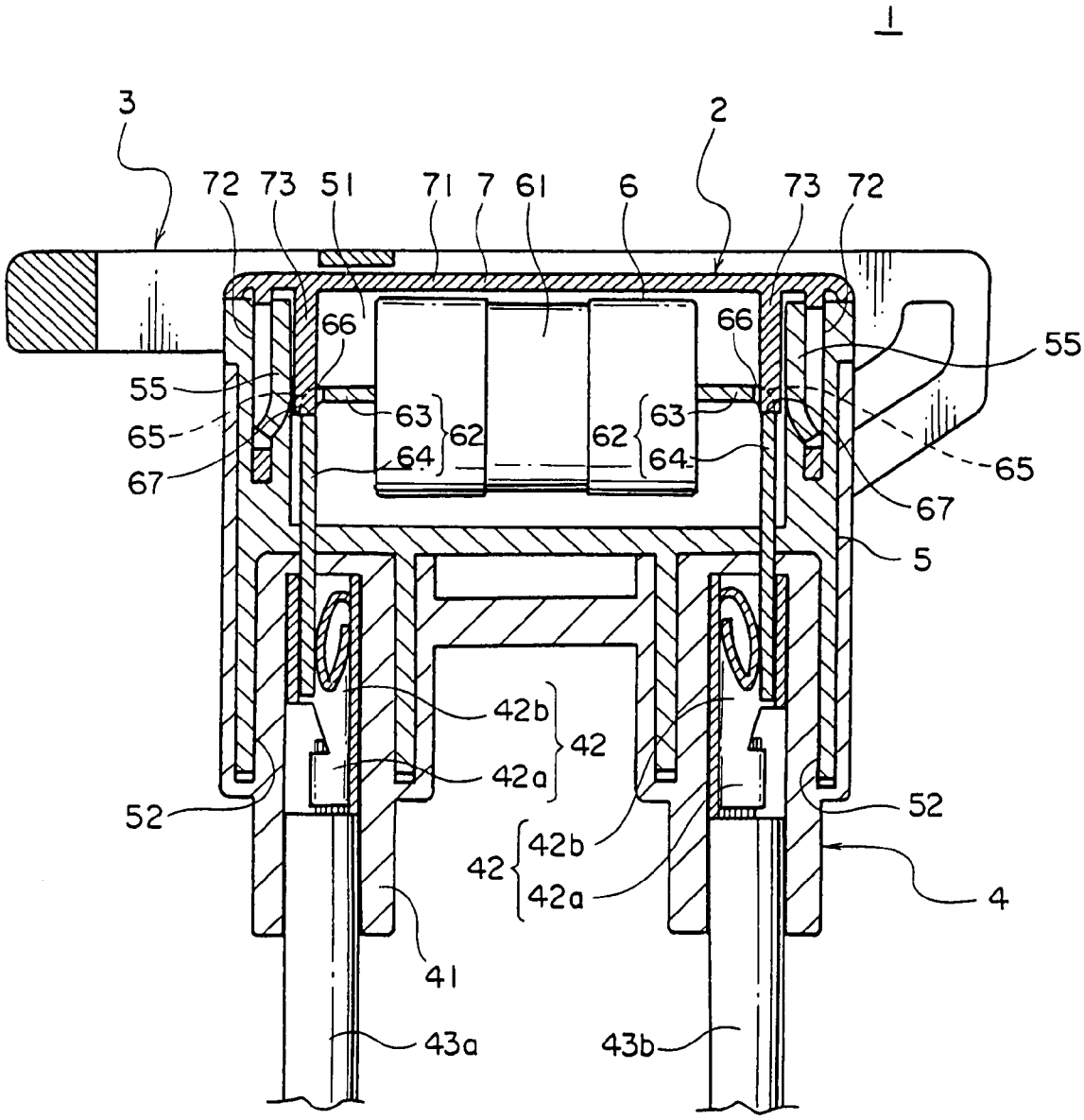
FIG. 4 is a cross sectional view taken along A-A line in FIG. 1.

As shown in FIG. 4, the locking part 72 engages with a mating locking part 55 formed in the housing body 5, so that the cover 7 is fastened to the housing body 5.

Figure 5:
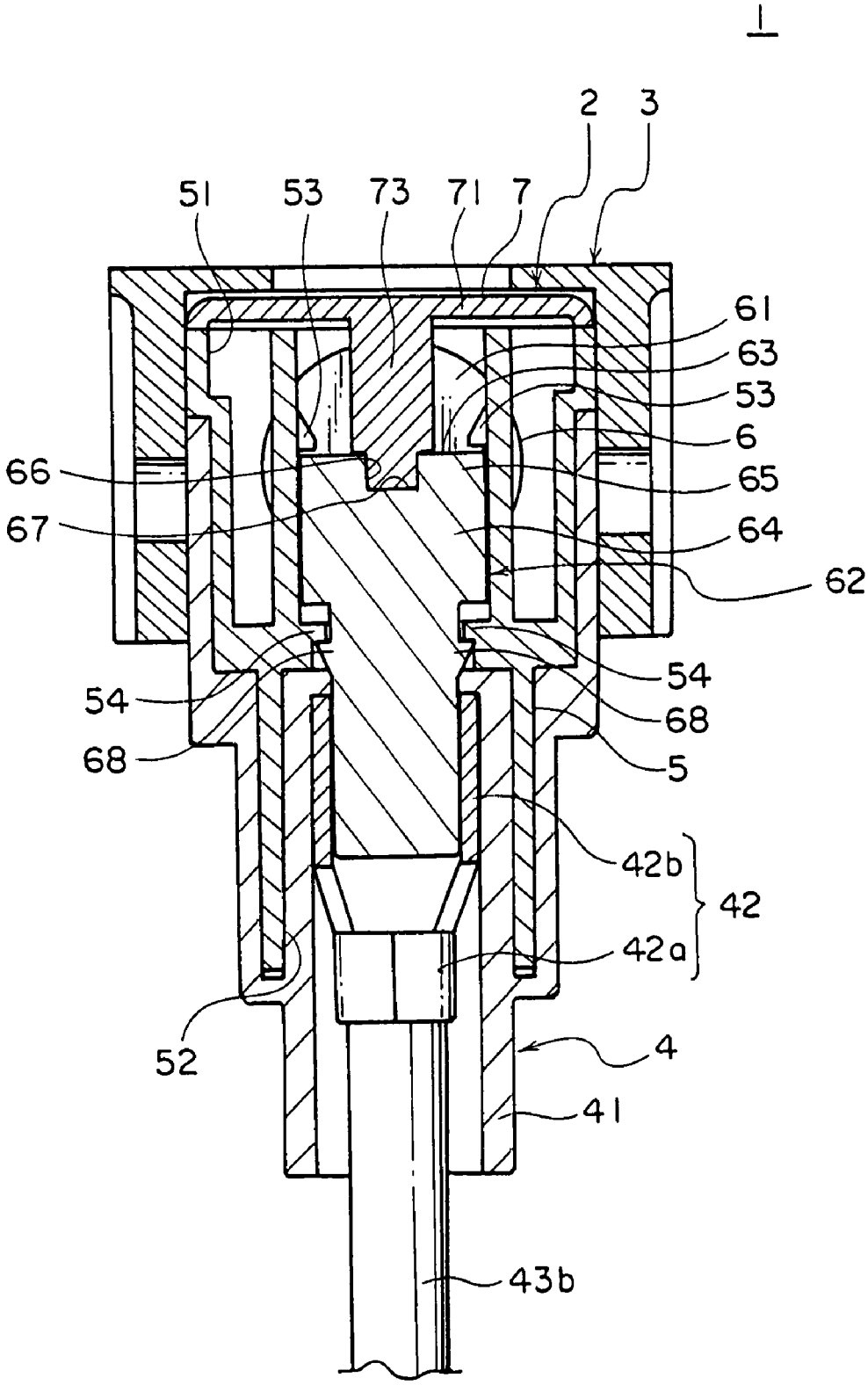
FIG. 5 is a cross sectional view taken along B-B line in FIG. 1.

As shown in FIGS. 4 and 5, an end part of the presser part 73 situated away from the cove body 71 is formed to mate with the notch 66 of the fuse 6. On a condition that the cover 7 is attached to the housing body 5, the end part of the presser part 73 abuts against the notch 66 and presses the cross section 67 toward the housing body 5, so that the fuse 6 is securely prevented from coming out from the housing body 5 and the looseness between the fuse 6 and the housing body 5 is absorbed. Since the presser part 73 presses the cross section 67 along the direction of the flat surface of the second surface 64, therefore the terminal 62 can be held in the housing body 5 without being deformed.

As shown in FIG. 4, the circuit receiver 4 includes a housing body 41 made of synthetic resin and a pair of circuit terminals 42 received in the housing body 41. The pair of circuit terminals 42 is formed by bending an electrically conductive sheet metal and includes an electric wire connecting part 42*a* for caulking the electric wire and an electric contact part 42*b*, which is formed in a rectangular tube shape and receives the terminal 62 of the plug body 2 therein. The electric wire connecting part 42*a* of one circuit terminal 42 is connected to an end of an electric wire 43*a* connected to a battery as an electronic instrument, while the electric wire connecting part 42*a* of another circuit terminal 42 is connected to an end of an electric wire 43*b* connected to a load as an electronic instrument. The pair of the circuit terminals 42 is arranged having a distance therebetween and constructs an opened power circuit.

In the power circuit breaker 1 having a construction described above, the plug body 2 is mounted into the circuit receiver 4 by operating the lever 3, so that the second surface 64 of the pair of the terminals 62 of the plug body 2 is received in the electric contact parts 42*b* of the pair of the circuit terminals 42, thereby connecting the pair of the terminals 62 and the pair of the circuit terminals 42 to each other. As a result, the electric wires 43*a* and 43*b* connected to the pair of the circuit terminals 42 are electrically connected through the fuse 6 so as to close the power circuit, that is, to construct the closed power circuit. When an overcurrent flows in the power circuit, the fuse element of the fuse 6 melts so as to break the power circuit.

When maintenance of the power circuit equipped with the power circuit breaker 1 or replacement of the fuse 6 is carried out, the plug body 2 is released from the circuit receiver 4 by rotating the lever 3 in a reverse rotation direction, so that the electrical connection between the pair of the terminals 62 of the plug body 2 and the pair of the circuit terminals 42 of the circuit receiver 4 is electrically broken. Thereby, the electrical connection between the electric wires 43*a* and 43*b*, which are connected to the respective circuit terminals 42, is electrically broken so that the power circuit is electrically broken. As a result, the maintenance of the power circuit can be safely carried out.

According to the preferred embodiments described above, since the bent part 65 of the fuse 6 is provided with the notch 66 formed ranging to both of the first surface 63 and the second surface 64, therefore the jig 10 can be allowed to abut against the notch 66 and press the cross section 67 of the second surface 64 along the direction of the flat surface of the second surface 64. Thereby, the fuse 6 can be press-fit into the housing body 5 without deforming the terminals 62, so that the manufacturing yield can be improved. Further, since the fuse 6 can be press-fit and mounted into the housing body 5 without using a fixing structure such as a screwing structure, therefore the power circuit breaker 1, which is easy to assemble and has a simple structure with a small number of components, can be provided. Furthermore, since the fuse 6 and the cover 7 can be assembled to the housing body 5 by bringing them straight close to the housing body 5, therefore the assembling can be automated.

In the preferred embodiments described above, the terminals 62 of the fuse 6 are directly connected to the female circuit terminals 42 formed in the circuit receiver 4. However, in the present invention, a male terminal may be used as the circuit terminal and another terminal may be put between the male circuit terminal and the terminal 62 of the fuse 6, so that the male circuit terminal is indirectly connected to the terminal 62 of the fuse 6.

The aforementioned preferred embodiments are described to aid in understanding the present invention and variations may be made by one skilled in the art without departing from the spirit and scope of the present invention.

What is claimed is:

1. A fuse comprising:

a tube-shaped housing;

a fuse element received in the housing; and a pair of plate-shaped terminals, one end part of which is received in the housing and connected to the fuse element, while an opposite end part of which is positioned outside the housing, wherein the plate-shaped terminal is provided with a bent part bent in such a manner that a surface on the side of the one end part and a surface on the side of the opposite end part meet each other at right angles, wherein a central curving portion of the bent part is provided with a notch to be pressed by a jig for press-fitting the fuse into a connector housing, into which the fuse is mounted, and wherein the opposite end part of the terminal includes a cross section exposed by providing the notch, so the cross section is pressed, by the jig pressing the notch, along a direction of the surface on the side of the opposite end to hold the terminal in the housing.

2. A power circuit breaker comprising:

a first connector housing into which the fuse according to claim 1 is press-fit and mounted; and a second connector housing including a pair of circuit terminals, each of which is connected to an electronic instrument and is capable of connecting to the plate-shaped terminal, the second connector housing being capable of filling to the first connector housing, wherein the pair of the plate-shaped terminals of the fuse is connected to the pair of the circuit terminals when the first and second connector housings are fit to each other.

3. The power circuit breaker according to claim 2, wherein the first connector housing has a cover including:

a cover body covering a side of the first connector housing on which side the fuse is mounted; and a presser part which rises up from the cover body and fits with the notch so as to prevent the fuse from coming out from the first connector housing.

* * * * *